United States Patent [19]

Kühn et al.

[11] 4,029,009

[45] June 14, 1977

[54] PRINTING MACHINE CONSTRUCTION

[75] Inventors: Wilfried Kühn, Dresden; Wilfried Micklausch, Coswig, both of Germany

[73] Assignee: VEB Polygraph Leipzig Kombinat fur Polygraphische Maschinen und Ausrustungen, Leipzig, Germany

[22] Filed: July 17, 1975

[21] Appl. No.: 596,325

[52] U.S. Cl. ..... 101/231; 101/232; 101/409; 271/108; 271/276

[51] Int. Cl.[2] ..... B41F 21/06

[58] Field of Search ..... 101/408–410, 101/230–232; 271/80, 82, 276, 277, 108

[56] References Cited

UNITED STATES PATENTS

| | | | |
|---|---|---|---|
| 715,905 | 12/1902 | Tuck et al. | 271/108 |
| 1,575,892 | 3/1926 | Ashby | 271/108 |
| 1,666,004 | 4/1928 | Droitcour | 271/276 |
| 2,712,935 | 7/1955 | Gegenheimer | 271/276 |
| 3,341,192 | 9/1967 | McMahon | 271/94 |
| 3,617,048 | 11/1971 | Albert | 271/108 |
| 3,796,154 | 3/1974 | Weisgeyber | 101/232 |
| 3,829,085 | 8/1974 | Jeschke et al. | 271/108 |

FOREIGN PATENTS OR APPLICATIONS

| | | | |
|---|---|---|---|
| 1,128,078 | 9/1968 | United Kingdom | 101/230 |

*Primary Examiner*—Edgar S. Burr
*Assistant Examiner*—William Pieprz
*Attorney, Agent, or Firm*—Michael J. Striker

[57] ABSTRACT

A first and a second printing roller are provided, each of which prints a different side of a sheet. A transfer roller is located between these printing rollers and forms tangent points with the same. The transfer roller has a hollow suction bar which extends over its entire axial length and which, when the sheet travels on the first printing roller and its trailing edge moves through the tangent point, picks the trailing edge off the surface of the first printing roller and furnishes it to a combined suction-and-mechanical gripper unit which takes the trailing edge from the suction bar and, during further rotation of the transfer roller, offers it to grippers of the second printing roller so that, when the trailing edge is engaged by the grippers of the second printing roller, and is then pulled onto the second printing roller for printing of the sheet thereon, the trailing edge becomes converted into the leading edge, so that the sheet is reversed side-for-side during the transfer between the first and second printing roller by the transfer roller.

6 Claims, 4 Drawing Figures

FIG. 2
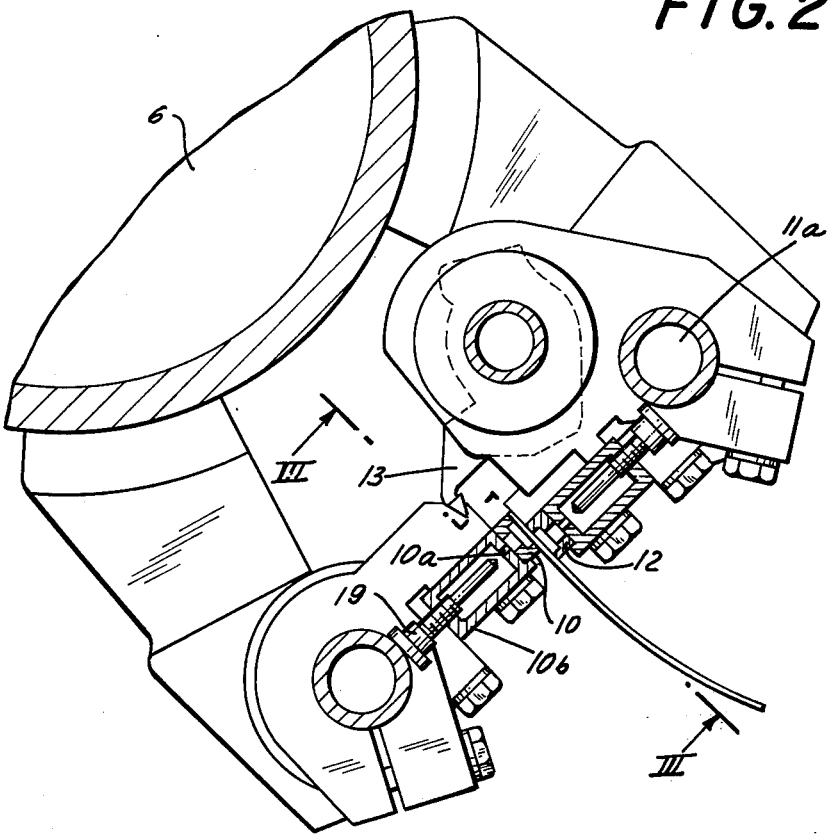
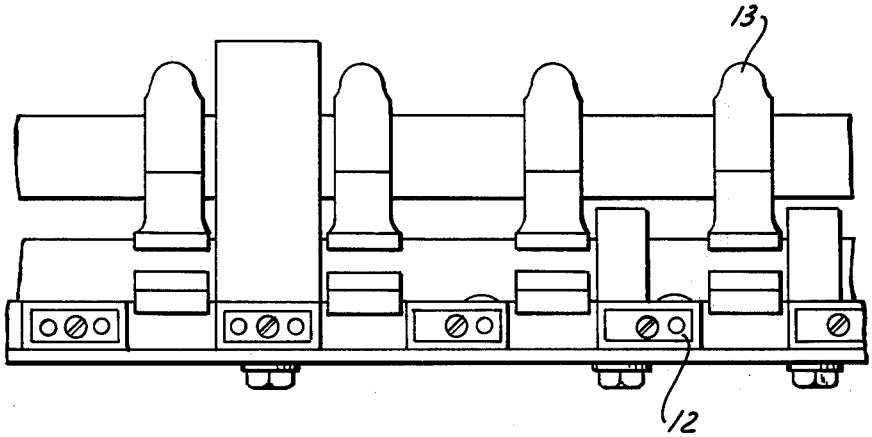
FIG. 3

PRINTING MACHINE CONSTRUCTION

BACKGROUND OF THE INVENTION

The present invention is generally concerned with a printing machine construction, and more particularly is directed to an improvement in the transfer of sheets between a first and a second printing roller of a printing machine, which respectively print two opposite sides of a sheet.

The concept of transferring a sheet from one printing roller to a succeeding one, and reversing the sheet side-for-side so that each of the printing rollers will print on a different side of the sheet, is already known, for example, from DDR Pat. No. 54,703. In this prior-art patent the sheet is engaged at the tangent point defined by the transfer roller and the first printing roller, by means of a suction gripper system which upon engagement moves inwardly of the outline of the transfer roller and yields the sheet to a mechanical gripper system. The mechanical gripper system, which at this time also is in a position in which it is pivoted inwardly of the outline of the transfer roller, now pivots outwardly of the outline and, during continued rotation of the transfer roller, offers what was previously the trailing edge of the sheet (while the same was still on the first printing roller) as the leading edge to the gripper system of the second printing roller, so that the sheet becomes reversed side-for-side and the second printing roller is now able to print upon the side of the sheet opposite the one that was printed by the first printing roller.

The suction system is composed of a plurality of individual suction grippers which are distributed over the axial length of the transfer roller and intermediate which there are free spaces into which the mechanical grippers engage. The holding force exerted by the suction gripper system upon the trailing edge of the sheet as it picks the same off the first printing roller is limited by the degree of vacuum the surface area over which the suction engagement takes place and the coefficient of friction between the individual suction grippers and the paper of the sheet. Particularly at high operating speeds this suction effect may not be sufficient to withstand the forces that act upon it, such as the inertia of the sheet during the phase during which the latter is accelerated by the transfer roller, the force with which the sheet tends to adhere to the surface of the first printing roller, the frictional force that must be overcome between the sheet and the first printing roller as the sheet is pulled off the surface of the printing roller, the force of gravity and the air resistance. Because of this, when certain types of paper are used at high operating speeds, for example 8,000 sheets per hour, the differences in the sheet position with reference to the sheet guiding elements may result. The holding force of the suction gripper system is particularly limited due to the small surface area of engagement between the sheet and the individual suction grippers, since only approximately 50% of the trailing edge of the sheet will be in engagement with the suction grippers.

SUMMARY OF THE INVENTION

Accordingly, it is an object of the present invention to provide an improved construction which eliminates the aforementioned problems.

Another object of the invention is to provide such an improved construction wherein an increase in productivity of rotary printing machines is obtained.

Another object of the invention is to provide such an improved construction which offers an increase in the productivity of multi-color rotary sheet printing machines in perfection and other types of printing.

An additional object of the invention is to provide such an improved construction wherein the force of suction with which the trailing edge of a sheet is engaged by the transfer roller suction system, is improved and wherein the drive for the transfer arrangement is simplified.

In keeping with these objects, and with others which will become apparent hereafter, one feature of the invention resides in a printing machine which, briefly stated, comprises a combination of a first printing roller for printing on one side of a sheet, a second printing roller for printing on the opposite side of the same sheet, and means for transferring the sheet from the first to the second printing roller. This means comprises a transfer roller intermediate the first and second printing rollers and forming with the first printing roller a tangent point, a hollow suction bar on the transfer roller extending over the axial length thereof and operative for picking a trailing edge of the sheet off the first printing roller as the trailing edge travels through the tangent point, and a combined suction-and-mechanical gripper system operative for receiving the trailing edge from the suction bar and presenting it to the second printing roller so that it becomes the leading edge when the sheet is on the second printing roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a fragmentary detail view, partly in section and on an enlarged scale, showing a portion of the apparatus in the position in which the trailing edge of a sheet is transferred by the suction bar to the combined suction and mechanical gripper system;

FIG. 3 is a developed view, as seen on line III—III of FIG. 2; and

DESCRIPTION OF THE PREFERRED EMBODIMENTS

Figure 1:
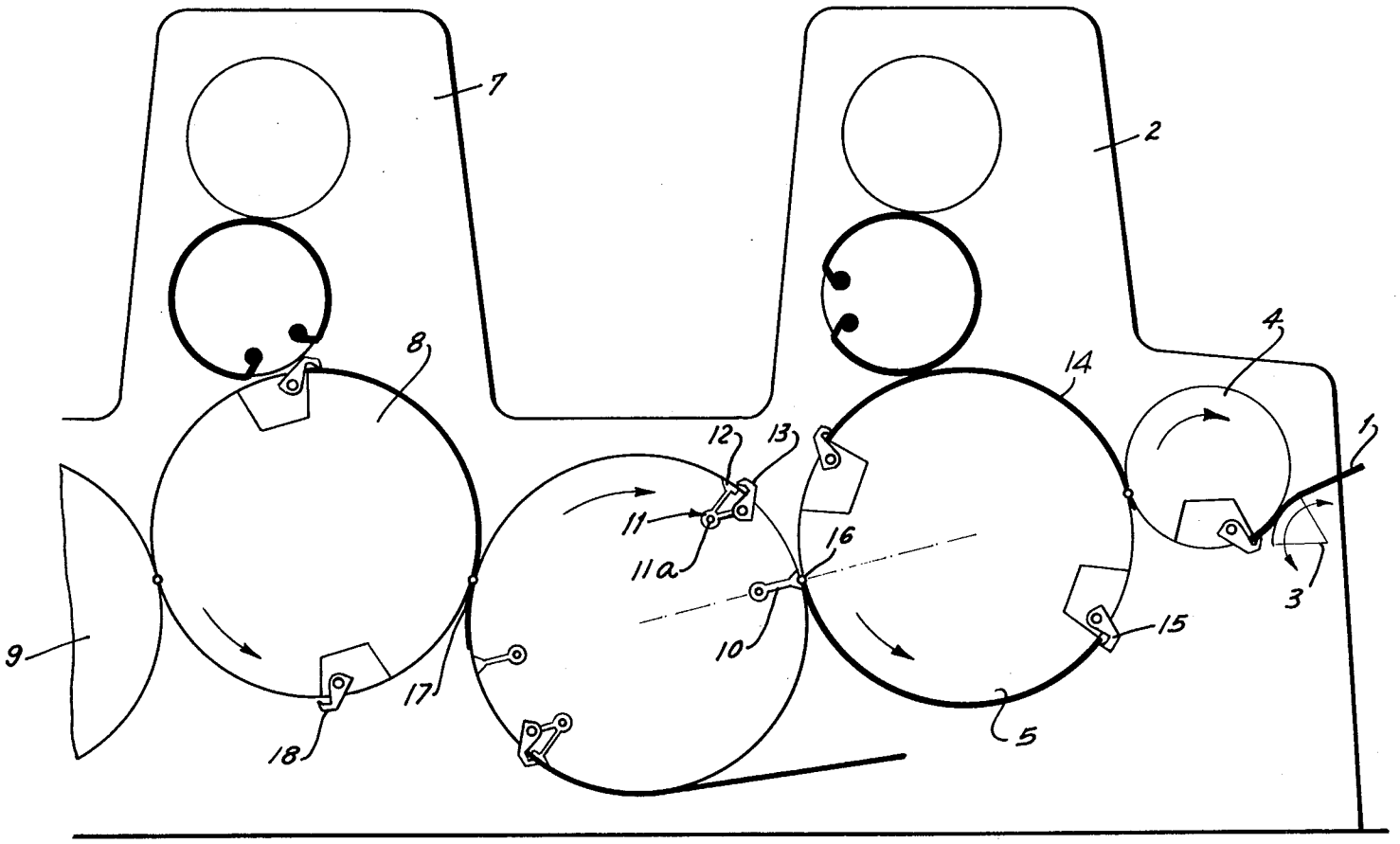
FIG. 1 is a diagrammatic side view of a rotary printing machine embodying the invention.
Figure 4:
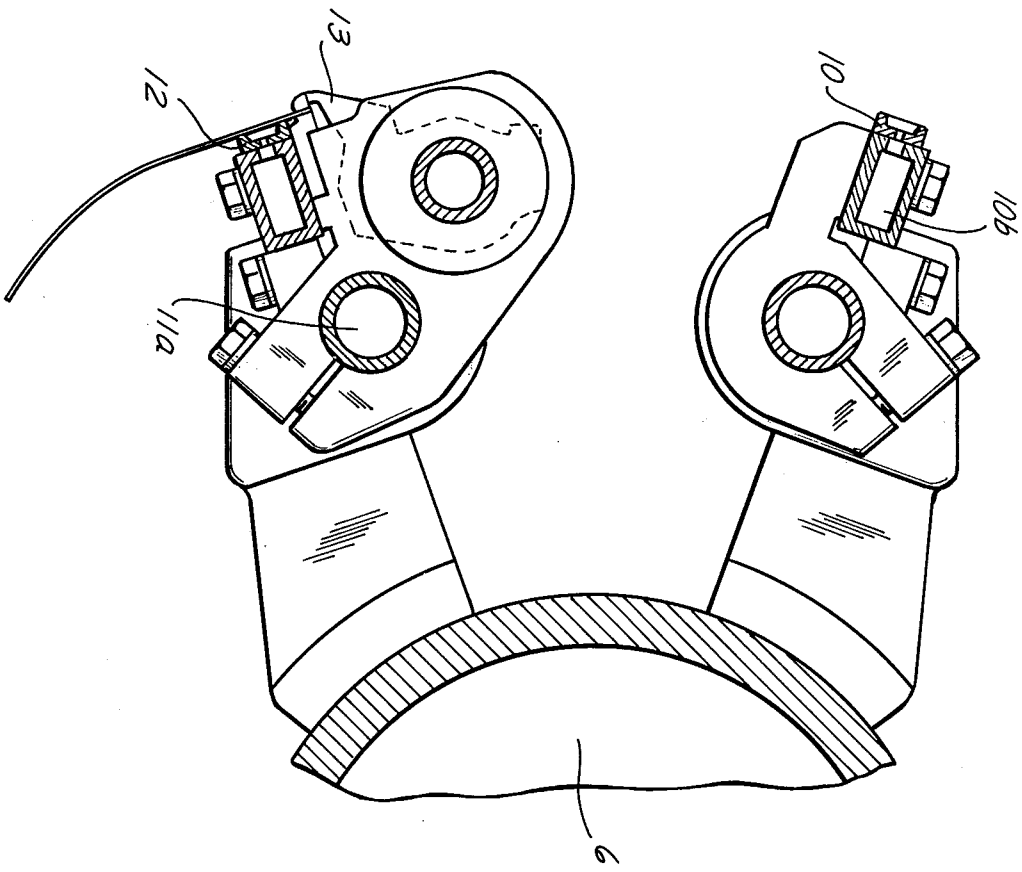
FIG. 4 is a view analogous to FIG. 2, but illustrating the arrangement in a different operating position.

Referring firstly to FIG. 1 it will be seen that in this Figure we have illustrated very diagrammatically a rotary printing machine, for example a multi-color rotary sheet printing machine. The printing machine has two successive printing stations 2 and 7. A feeding table 1 is provided at which sheets 14 are fed to the first printing station 2, for which purpose an initial gripper 3 is provided that engages the sheets on the table 1 and feeds them to a sheet feeding roller 4 whose illustrated gripper engages the sheets and transfers them to the grippers 15 of a first printing roller 5 of the printing station 2. The direction of rotation of all the rollers is indicated by respective arrows in FIG. 1. It will be seen that one side of the respective sheet 14 can be printed as the sheet travels on and with the printing roller 5.

In order for the opposite side of the same sheet 14 to be printed by the printing roller 8 of the second printing station 7 it is necessary that the sheet be reversed side-for-side. For this purpose a sheet transfer means is provided, including a sheet transfer roller 6 which is located between the printing rollers 5 and 8 and forms with the two respective tangent points 16 and 17.

According to the present invention, the sheet transfer roller 6 is provided with suction bars 10 (usually two as illustrated) which are axially coextensive with the transfer roller 6 and which can pivot between the illustrated position and a position in which they pivot inwardly of the outer circumference of the transfer roller 6, in a counterclockwise direction. The purpose of this inward pivoting is to move the outer end of the respective suction bar 10 closer towards a combined suction and mechanical gripper system 11 which also pivots about an axis 11*a* inwardly of the outline of the roller 6 in clockwise direction, i.e. towards the suction bar 10. The system 11 is composed of a plurality of individual suction grippers 12 and mechanical grippers 13 which are mounted over the axial length of the sheet transfer roller 6. It will also be possible to utilize all mechanical grippers or all suction grippers if desired. If a combination of suction grippers 12 and mechanical grippers 13 is provided, then each mechanical gripper will be mounted between two suction grippers 12 which are spaced axially of the roller 6.

The drives for pivoting the suction bar 10 and the system 11 to their respective positions are not illustrated, because these are well known in the art and persons having ordinary skill in this art can be expected to be completely conversant with them.

The suction bar 10 has a center portion and two opposite end portions. The center portion has a length in direction axially of the sheet transfer roller 6 which corresponds to the minimum sheet format that is to be printed on the machine. The end portions of the suction part 10 are subdivided into individual compartments each of which can be individually and separately connected with a suction source, so that individual ones of the compartments can be connected to the source of suction in dependence upon the size of the sheet format, thereby assuring that the entire trailing edge of the respective sheet 14 will be engaged by suction via the suction bar 10.

The suction bar 10 is mounted on or otherwise connected with a manifold 10*b* that extends axially of the sheet transfer roller 6, and each of the compartments mentioned before is provided with an opening that communicates with an opening 10*a* in the suction manifold 10*b*. For each opening the suction manifold 10*b* carries a screw 19 which can be retracted from the associated opening 10*a* as shown in FIG. 2, so as to permit the compartment in question to communicate with the interior of the suction manifold 10*b* through the opening 10*a* or which can be advanced until the leading end of the respective screw 19 blocks the associated opening 10*a* and thus disconnects the compartment of the suction bar 10 from the source of suction, i.e. from the suction manifold 10*b*.

In operation of the machine in FIGS. 1–4, sheets 14 are supplied via the feeding table 1 and the gripper 3 to the sheet feeding roller 4 from which they are picked up by the grippers 15 of the first printing roller 5. Upon travelling with the first printing roller 5 one side of each sheet 14 becomes printed. Thereupon, the respective sheet 14 travels through the tangent point 16 between the printing roller 5 and the sheet transfer roller 6. As the trailing edge of the sheet 14 travels through this tangent point it is engaged by the suction bar 10 and, during rotation of the sheet transfer roller 6 in the direction indicated by the arrow in FIG. 1, this trailing edge is lifted off the circumferential surface of the printing roller 5 and at the same time pivoted inwardly of the outline of the transfer roller 6 due to the pivoting of the suction bar 10. It will be appreciated that in conventional manner the transfer roller 6 does not have a solid circumferential surface, but instead has end plates or the like and intermediate these end plates has the suction bars 10 and systems 11 mounted.

When the suction bar 10 with the engaged trailing end of the sheet 14 has pivoted inwardly in counterclockwise direction an reached the position shown in FIG. 2, the system 11 has also pivoted inwardly but in clockwise direction and is now ready for the grippers 12 and 13 to pick up the trailing edge of the sheet 14 from the suction bar 10. The actual pick-up from the suction bar 10 is effected by the suction grippers 12 at this time and the engagement of the trailing edge by the mechanical grippers 13 takes place when after the pick-up by the suction grippers 12 the system 11 is pivoted outwardly again, this being shown in FIG. 4. Continued rotation of the sheet transfer roller 6 now causes the sheet 14 to be pulled off the printing roller 5, and thereby to become reversed side-for-side as shown for the sheet that is illustrated as being engaged by the one system 11 of the sheet transfer roller 6, and during further rotation of the roller 6 the system 11 now offers the previously trailing edge (now the leading edge) of the sheet 14 to a gripper 18 of the printing roller 8 of the second printing station 7. The transfer from the system 11 to the gripper 18 takes place at the tangent point 7 formed by the sheet transfer roller 6 with the printing roller 8. The latter now prints on the previously blank side of the sheet 14 and thereupon the sheet 14 is removed from the machine by the diagrammatically illustrated discharge device 9 which does not form a part of the invention.

It should be mentioned that just as those longitudinal parts of the suction bar 10 which are not required for purposes of engaging the trailing edge of a sheet 14 on the printing roller 5, because of the particular format of the sheet, can be shut off, so also can the individual suction grippers 12 of the system 11 be shut off which are not required because of the particular format of the sheet.

It will be understood that each of the elements described above, or two or more together, may also find a useful application in other types of constructions differing from the types described above.

While the invention has been illustrated and described as embodied in a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a printing machine, a combination comprising a first printing roller for printing on one side of a sheet; a second printing roller for printing on the opposite side of said sheet; and means for transferring said sheet from said first to said second printing roller, comprising a transfer roller intermediate said first and second printing rollers and forming with said first printing roller a tangent point, hollow suction bar means on said transfer roller extending over the axial length thereof and operative for engaging a trailing edge of said sheet by suction over the entire elongation of said trailing edge in the direction of said axial length of said transfer roller and for lifting said trailing edge off said first printing roller as said trailing edge travels through said tangent point, means mounting said suction bar means for movement between a position adjacent the periphery of said transfer roller and a position inwardly of said periphery, and combined suction-and-mechanical gripper system means for taking over said trailing edge from said suction bar means and having a row of individual suction grippers for receiving said trailing edge and moving it away from said suction bar means and a plurality of individual mechanical grippers adapted to engage and take over said trailing edge from said suction grippers only after said trailing edge has been received away from said suction bar means by said switch grippers so as to avoid interference between the latter and said mechanical grippers, whereupon said mechanical grippers present said trailing edge to said second printing roller so that it becomes the leading edge when said sheet is on said second printing roller.

2. A combination as defined in claim 1, wherein said suction bar means is axially coextensive with said transfer roller.

3. A combination as defined in claim 1, wherein said suction bar means is subdivided into a plurality of separate sections.

4. A combination as defined in claim 3; and further comprising means for selectively connecting the respective sections with a source of suction.

5. A combination as defined in claim 4, wherein said source of suction comprises a suction manifold, and said sections each have an aperture communicating with said manifold; said connecting means being operative for individually blocking and unblocking each of said apertures.

6. A combination as defined in claim 5, wherein said connecting means comprises a plurality of screws each individually movable to and from a position in which a leading end of the screw blocks one of said apertures.

* * * * *